US005649577A

United States Patent [19]

Farkas

[11] Patent Number: 5,649,577

[45] Date of Patent: Jul. 22, 1997

[54] METHOD AND APPARATUS FOR AUTOMATICALLY STOPPING THE PROCESS OF FILLING OF A TANK WITH A LIQUID UNDER GAS OR VAPOR PRESSURE

[76] Inventor: Edward J. Farkas, 34 Lyonsgate Dr., Downsview, Ontario, Canada, M3H 1C8

[21] Appl. No.: 454,437

[22] Filed: May 30, 1995

[51] Int. Cl.[6] ..... B67D 5/00

[52] U.S. Cl. ..... 141/198; 141/5; 141/128; 141/83; 137/393

[58] Field of Search ..... 141/2, 5, 59, 83, 141/95, 128, 198, 206; 220/86.1, 86.2, 89.1; 137/393

[56] References Cited

U.S. PATENT DOCUMENTS

| | | | |
|---|---|---|---|
| 3,916,961 | 11/1975 | Dilger | 141/198 X |
| 3,929,155 | 12/1975 | Garretson | 141/198 X |
| 4,974,645 | 12/1990 | Johnson | 141/59 |
| 5,131,441 | 7/1992 | Simpson et al. | 141/206 X |
| 5,172,721 | 12/1992 | Sato et al. | 220/86.2 X |
| 5,205,330 | 4/1993 | Sekine | 141/59 |
| 5,381,838 | 1/1995 | Watanabe et al. | 141/198 |
| 5,388,622 | 2/1995 | Phillips | 141/198 |

*Primary Examiner*—J. Casimer Jacyna

*Attorney, Agent, or Firm*—Flehr Hohbach Test Albritton & Herbert LLP

[57] ABSTRACT

The invention described in the patent comprises a method and an apparatus for automatically stopping the process of filling of a tank or container with a liquid, where the liquid must always be maintained under a gas or vapor pressure higher than atmospheric pressure. In the situations to which the invention is addressed, the tank is not to be filled completely with liquid. If the tank is correctly filled, there is at the end of the filling process a certain fraction of the total internal tank volume which is still occupied by gas or vapor. The invention provides for automatically stopping the fill at the correct point, through installation of one of several different devices within the tank, and through the operation of a microprocessor which receives signals from sensors located in the liquid supply system, upstream of the filling hose. In addition to automatically stopping the filling process at the correct point, the apparatus of the invention is self-monitoring and provides a warning of any malfunction, such as an overfilled tank.

3 Claims, 3 Drawing Sheets

METHOD AND APPARATUS FOR AUTOMATICALLY STOPPING THE PROCESS OF FILLING OF A TANK WITH A LIQUID UNDER GAS OR VAPOR PRESSURE

RELATED APPLICATION

Control System for Filling of Tanks with Saturated Liquids, Ser. No. 08/212,811, filed Mar. 15, 1994 now abandoned.

BACKGROUND OF THE INVENTION

In industry and commerce, it is frequently necessary to deal with liquids which must be kept under a gas or vapor pressure greater than atmospheric pressure. Filling of tanks or containers under these conditions requires specialized techniques. In particular, it is usually necessary to ensure that the tank or container does not become completely filled with liquid. A specified gas or vapor space must remain at the end of the filling process. The techniques currently known to those skilled in the art for ensuring that the required gas or vapor space remains in the tank have serious deficiencies, for example in such applications as filling of fuel tanks of motor vehicles which utilize propane or liquefied petroleum gas (LPG) as fuel.

FIELD OF INVENTION

The present invention provides an improved apparatus and an improved method for filling of tanks or containers where the liquid to be handled must be kept under a gas or vapor pressure which is higher than atmospheric pressure. In these applications for one of several reasons it is desired that the liquid not fill the tank volume completely. It might be desired to fill the tank with liquid to the extent, for example, of 80% of the total internal volume of the tank. A tank filled to this extent is said to be correctly filled. The method and the apparatus of the present invention specifically act in an automatic manner to stop the filling process at the point when the tank has become correctly filled.

The present invention utilizes the principles of chemical engineering, in the area of gas, vapor and liquid properties, and in the area of flow phenomena of gas, vapor, and liquid. The present invention also utilizes microprocessor control in order to achieve automatic operation and self-monitoring of the process to provide a warning of malfunction.

DESCRIPTION OF PRIOR ART

In order to automatically stop the filling process when the tank or container has been correctly filled, the empty tank or container can be placed on a scale. The weight of the tank and contents, when the tank is correctly filled, is entered into a controller. A hose is connected to the tank, and the filling process begins. The controller monitors the weight of the tank continuously. When the specified weight is reached, the controller stops the filling process. The disadvantage of this method is that it is limited to portable tanks which can be placed on a scale. This method could not be used with, for example, motor vehicle fuel tanks permanently installed in the vehicle.

A sensor could be placed in or on the tank. The sensor would be such that it can detect the difference between liquid and gas or vapor. The sensor would be placed at the position on the tank which corresponds to the maximum allowable liquid level in the tank. The sensor signal would be transmitted to a controller. The disadvantage of this method is the necessity of placing a sensor on each tank, either permanently or at the time of filling of the tank. The need for the sensor and the need for transmitting the sensor signal to the controller are unacceptable in terms of cost and complexity of operation in many types of filling processes.

A method which is in commercial use utilizes a mechanical valve permanently installed inside the tank. The valve senses liquid level in the tank. When the liquid level rises to the maximum allowable position, the valve closes off the flow of liquid to the tank. The disadvantage of this method is that there is no self-monitoring. In the event that the valve malfunctions, and fails to stop the flow of liquid at the correct point, the operator or user of the system has no way of knowing that there is a malfunction and that the tank may be overfilled.

The apparatus and the method of the present invention resolve the problems inherent in the prior or existing art. The apparatus and the method of the present invention can be used with any tank or container, whether portable or fixed in a larger piece of equipment. In the apparatus and the method of the present invention, information on the status within the tank is transmitted via the flow path of the liquid which is being supplied to the tank. There is no need for a separate means, such as use of the weight of the tank and contents, or use of a signal from a sensor on the tank, to transmit information from the tank to a controller. Finally, and very importantly, the apparatus and the method of the present invention combine the features listed above with the additional feature of fully automatic, self-monitoring operation.

SUMMARY OF THE INVENTION

The present invention provides automatic control of the filling of tanks with liquids which must be kept under a gas or vapor pressure which is higher than atmospheric pressure.

The apparatus and the method of the present invention operate in the following manner:

1. The apparatus and the method of the present invention involve a microprocessor, which is located remotely from the tank being filled. The microprocessor receives information indicating when the tank has been correctly filled. At this time the microprocessor shuts off the flow of liquid to the tank, by closing a simple on/off valve which is located outside the tank, and well upstream of the tank, typically upstream of the filling hose which is connected to the tank during the filling process, or by shutting off the feed pump.

2. In different embodiments of the invention, different types of apparatus are permanently installed within the tank to be filled. In each case, the apparatus is simple, inexpensive, and extremely reliable. The function of this apparatus is to automatically create additional backpressure on the filling hose, at the point when the tank has become correctly filled.

3. The microprocessor contains suitable programming and receives information from sensors located in the dispensing system. There are no sensors in or on the tank which is being filled. On the basis of the information from the sensors, the microprocessor controls, monitors, and supervises the filling process. The sensor provides signals in response to changes in the flow in the filling hose, in turn created by the additional backpressure referred to above.

4. A filling process is started by a human operator or user of the filling equipment. The microprocessor stops the fill automatically when the tank has been filled to the correct level. The microprocessor stops the filling process immediately if an abnormal condition is indicated, on the basis of the information provided by the sensors and the programming with which the microprocessor is equipped.

5. Abnormal conditions which cause the microprocessor to refuse to start or continue a fill include sensor failure. Abnormal conditions which cause the microprocessor to provide an alarm include filling a tank which was already correctly filled at the time the filling process was started. A suitable warning is given in each case, and the control system does not allow further fills until the problem has been investigated and repaired, and the system reset by authorized personnel.

DETAILED DESCRIPTION OF THE INVENTION

Figure 1:
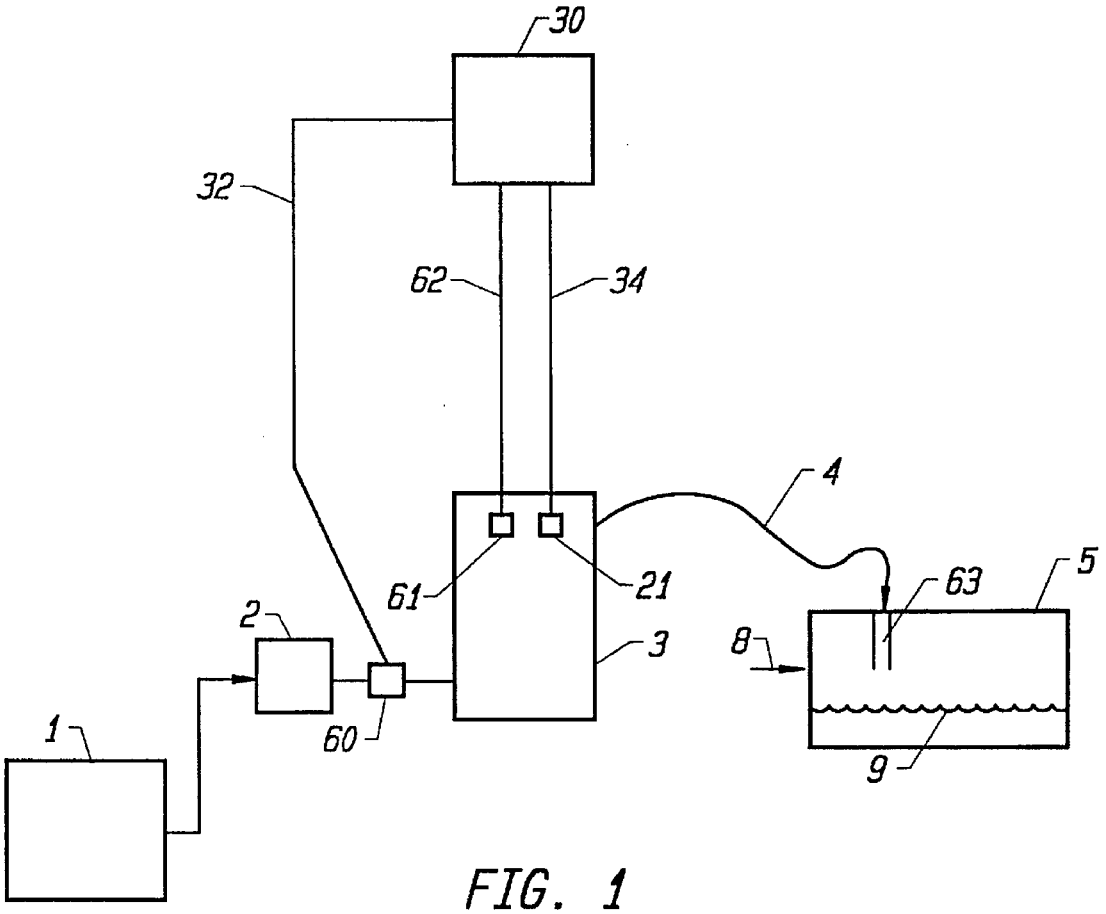
FIG. 1 provides a schematic of the first embodiment of the apparatus and method of the present invention. This embodiment is the simplest in terms of mechanical equipment required. Therefore this embodiment is the preferred embodiment where the properties of the liquid and gas or vapor being handled are such that this embodiment will provide the required increase in backpressure.

Any liquid expands when it is warmed. Consider a completely closed tank which is nearly filled with a liquid. Suppose the tank is warmed, for example by the sun shining on it. The liquid in the tank expands, and may come to completely fill the available internal volume of the tank. If there is further warming, and the liquid has no further available space within the tank into which it can expand, the liquid develops extremely large forces against the tank walls and the tank may split apart, releasing the liquid in an uncontrolled manner. Such a release is obviously undesirable, especially if the liquid is toxic or flammable.

Every liquid has associated with it a "vapor pressure" which is a function of temperature. The phrase "vapor pressure" has a very specific meaning well known to those skilled in the arts of chemistry and chemical engineering.

Vapor pressure is an intrinsic property of a given liquid at a given temperature and can be thought of as an outward force exerted on the surroundings, by the liquid.

The present invention is concerned with liquids for which the vapor pressure is greater than atmospheric pressure, at temperatures typical of those at which the liquid is handled in commerce and industry. This type of liquid cannot be placed in a tank which is open to the atmosphere. In a tank which communicates in any way with the atmosphere, the liquid would boil away and would be lost.

The present invention is also concerned with other types of liquids which for any reason must be kept under a positive gas or vapor pressure greater than atmospheric pressure. An example is a carbonated beverage, which if exposed to atmospheric pressure during processing or bottling would lose its carbonation.

In summary, liquids of the types described above must be stored in tanks or containers which do not communicate in any way with the atmosphere. In other words, these tanks are hermetically sealed. It then follows that in these cases the internal volume of the tank must never be completely full of liquid. If the tank is completely full, and if there is any warming, the liquid will exert enormous forces on the tank walls, since the tank is hermetically sealed and there is no way for the liquid to escape.

Thus with the types of liquids discussed above there is a need for a method of stopping the filling of the tank or container at the point where there is still an adequate portion of the internal volume of the tank which is not yet filled with liquid. At this point the tank is said to be correctly filled.

The amount of space not filled with liquid is determined on the basis of the thermal expansion coefficient of the liquid, and on the basis of the maximum expected warming that could occur after the tank is filled. Warming could occur if the tank is exposed to the sun, or if it is otherwise placed in a warm environment, for any reason. For example, it is accepted in the propane industry that the volume of liquid propane in the tank should be no more than 80% of the total internal volume of the tank, at the time of filling.

The problem of stopping the filling process at the correct point is complicated exactly by the fact that the tank is sealed. It is difficult to obtain information as to the status inside the tank. It is difficult to know when the liquid level has risen to the point that the tank is correctly filled but not overfilled.

If there is warming of the tank while there is still a portion of the tank which is not occupied by liquid, the liquid will expand and the pressure in the tank will increase. However there is no danger of splitting the tank because the gas or vapor in the space not occupied by liquid is compressible. As a result any pressure increase will be moderate.

It is only when the tank is completely filed with liquid that there is a problem. The liquid is essentially non-compressible and any further warming will probably lead to splitting of the tank.

In industrial practice, typically there is a supply tank from which liquid is drawn. This liquid is moved by pump or by other means to a tank which is to be filled.

There are several existing methods of stopping the fill when the tank has been correctly filled. One method utilizes a mechanical valve permanently installed inside the tank. All liquid supplied to the tank flows through this valve during the filling process. The valve incorporates a float arrangement. When the liquid level rises to the maximum allowable value, the float rises and closes the valve. Therefore no further liquid can flow into the tank. The pump referred to above keeps on running. The backpressure seen by the pump increases, because the in-tank valve has closed. In typical commercial and industrial practice, the increased backpressure causes a bypass line to open and the output of the pump returns to the supply tank.

The filling process has been completed and the pump may then be shut off by a human operator.

The disadvantage of this method is that in the rare event that the in-tank valve fails to close, the tank will be overfilled and the fact that it is overfilled will not be apparent to the human operator of the filling process. Therefore a dangerously overfilled tank could leave the filling station and go into use, where it may be exposed to warming. If the in-tank valve has developed a permanent malfunction, it may allow the tank to be overfilled each subsequent time that the tank has to be refilled.

It should be noted that all liquid supplied to the tank goes through the in-tank valve. Contaminants in the liquid may foul the valve, leading to a malfunction.

In the apparatus and the method of the present invention, the problems noted above are overcome in the following manner:

1. The device inside the tank is much simpler and in two embodiments there are no moving parts. In another embodiment there are moving parts but the device is much simpler than the in-tank valve described above. Therefore the embodiments of the apparatus and method of the present invention are not subject to fouling to the extent possible with the in-tank mechanical valve referred to above.

2. In any embodiment of the present invention, the device inside the tank is not intended to fully close off the flow of liquid. The device inside the tank is intended to be only a "partial close" device. The function of the partial close device is to somewhat restrict the flow of liquid to the tank, at the point where the tank has become correctly filled, without making any attempt to shut off the flow of liquid completely. Since the device is only a partial close device, there is no need for close clearances and high precision manufacture. Therefore the device is inherently less expensive and less subject to fouling.

3. There are sensors in the dispenser or other liquid supply system, immediately downstream of the pump which supplies the liquid, but well upstream of the tank or container which is being filled. These sensors provide information on flowing liquid temperature and pressure, and liquid flow rate, in the dispenser or supply system. This information goes to a microprocessor. When the partial close device adds to the flow restriction, the sensor signals change in a way that leads the microprocessor to conclude that the tank has been correctly filled. The microprocessor then closes a quick-operating valve immediately downstream of the pump, to stop the flow of liquid to the tank or container. The microprocessor may also turn off the pump.

4. If there is some abnormal condition which leads to flow of liquid to the tank continuing past the point where the tank is correctly filled, the tank becomes completely full, which is seen by the sensors and microprocessor as a total shut-off of flow, rather than a "partial close". The microprocessor then knows that the tank has been overfilled and sounds an alarm. The dispensing system is shut down until the source of the problem is identified and corrected. A portion of the tank contents is removed immediately, thus eliminating the hazard. The tank is also examined to see if the problem was caused by a malfunction or defect in the tank.

The advantages of the method and apparatus of the present invention, in comparison with the in-tank mechanical valve which is currently used, are:

1. The device inside the tank is simpler and less expensive and therefore inherently less likely to malfunction or fail.

2. In case of a malfunction leading to overfilling, an immediate warning is provided. The human operators of the process know immediately that a dangerous situation exists and can correct it.

These advantages are achieved fundamentally by separating the functions. In the currently existing technology, the in-tank valve is expected to sense liquid level and also to shut off flow to the tank.

In the apparatus and method of the present invention, the in-tank device essentially has only one function, and that is to send information on liquid level to the microprocessor. The microprocessor then acts to stop the filling process.

Figure 2:
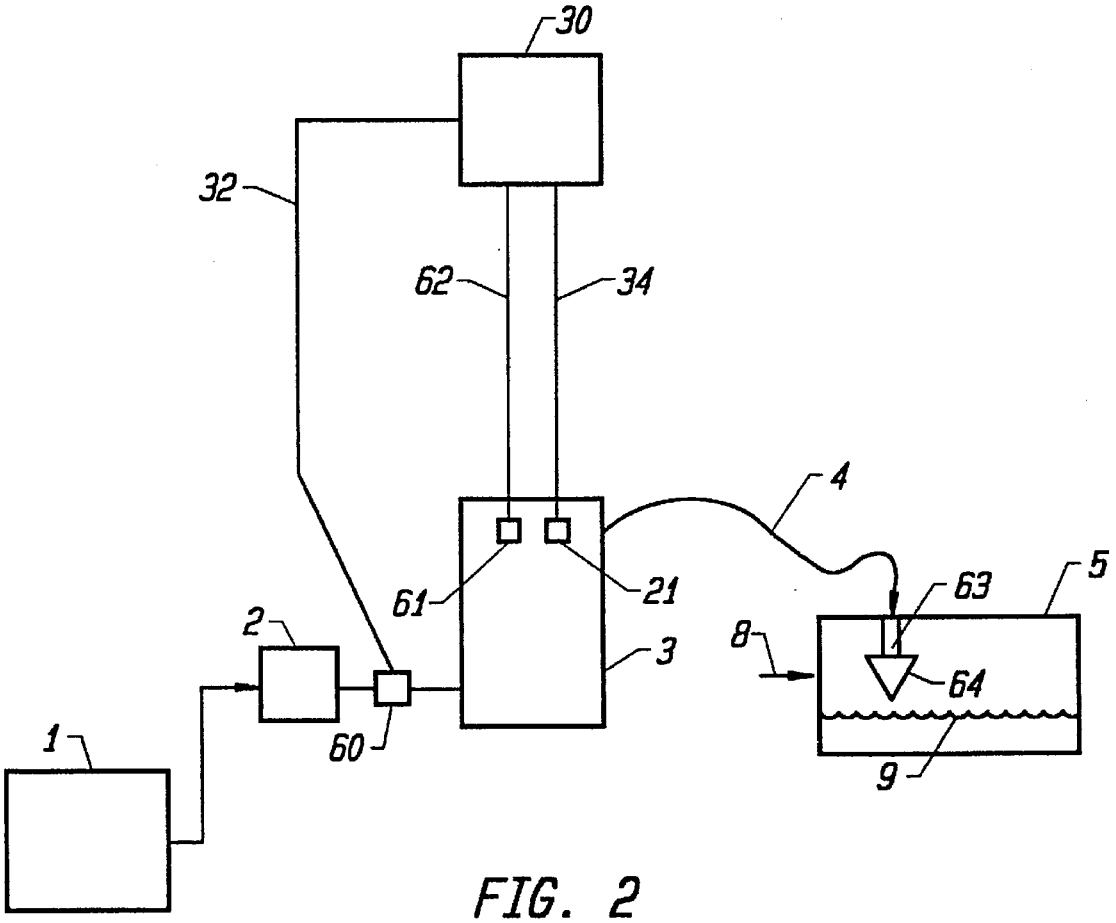
FIG. 2 provides a schematic of the second embodiment of the apparatus and method of the present invention. This embodiment may be preferred by industry because it has some relationship to existing art and also because it can be fitted to existing tanks.
Figure 3:
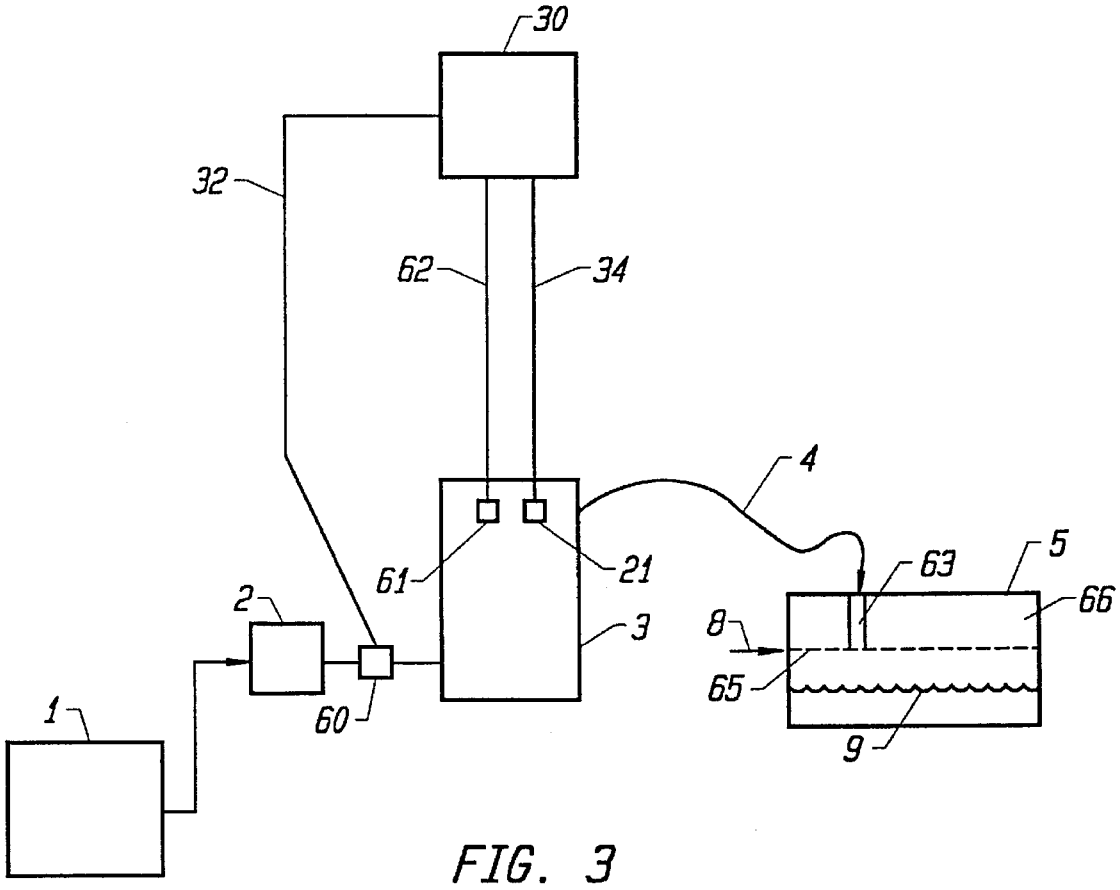
FIG. 3 provides a schematic of the third embodiment of the apparatus and method of the present invention. This embodiment may be preferred by industry, in relation to the embodiment presented in FIG. 2, on the basis of absence of moving parts. However, application of the embodiment presented in FIG. 3 may be limited to cases where it can be installed in new tanks at the time of manufacture of the tanks.

In FIGS. 1, 2, and 3, tank 5 is the tank to be filled with the liquid being handled. Liquid is drawn from a supply tank 1 by a pump 2. Instead of a pump, some other means could be used to create movement of the liquid from the supply tank 1 to the tank 5 which is to be filled. Any such alternate means would also be at location 2 in FIGS. 1–3.

The liquid flows through a quick opening and quick closing valve 60. Typically this valve would be an electrically operated valve such that if electric power is removed from the valve for any reason, the valve instantaneously and automatically closes and stops the flow of liquid.

The liquid then flows through a dispenser or dispensing system 3. There is a pressure sensor 21 and a flow rate sensor (flow meter) 61 in the dispensing system. The function of these sensors is described below. There can also be a temperature sensor in the dispensing system 3. This sensor is not shown separately in FIGS. 1–3 because, as is well known to those skilled in the art, many commercially available flow meters have an integral temperature sensor. All three sensors are in contact with the flowing liquid as it flows through the dispensing system 3. Therefore the sensors communicate flowing liquid conditions to the microprocessor 30.

The liquid then flows through a filling pipe or hose 4 to the tank 5. The filling hose is connected to the tank 5 by means which are well known to those skilled in the art. Hence these connection means are not shown in FIGS. 1–3. After the filling process is completed, the hose 4 is disconnected from the tank 5. The hose 4 remains with the dispensing system 3 at all times. The filling connection means consists of two parts each of which automatically closes when the connection is broken. In this way, communication between the interior of the hose 4 and the general surroundings, is prevented. Similarly, communication between the interior of tank 5 and the general surroundings is prevented.

The maximum allowable liquid level 8 in the tank 5 is indicated in FIGS. 1–3. At some time during a typical filling operation, the liquid level may be at the intermediate position 9.

Various other liquid-handling appurtenances which are needed in the handling of the types of liquids described above, such as backpressure valves, bypass valves, and bypass/return lines, are well known to those skilled in the art and are therefore not shown in FIGS. 1–3.

A key component in the apparatus and method of the present invention is a microprocessor or computer 30, which contains appropriate programming. The microprocessor 30 can be located within the dispenser 3 or elsewhere. The microprocessor receives information from the sensors 21 and 61 to be described later, via signal wiring 34 and 62. The microprocessor performs all functions of the present invention and also performs various other functions, thus providing complete control, monitoring, and supervision of all aspects of the filling equipment and the filling process.

When the human operator or user of the system desires to fill a tank, he or she first connects the hose 4 to the tank 5 to be filled. Then he or she turns on the pump 2 and operates a switch which in turn signals the microprocessor 30 to start the filling process. During a delay period of 1 to 2 seconds, the microprocessor carries out various checking procedures. If all conditions are normal, the microprocessor sends a signal, via signal wiring 32, to open the valve 60 so that flow of liquid can begin. Alternately, the pump 2 could also be under the control of the microprocessor. A further alternative, as already implied, is that there is a bypass arrangement from the outlet of the pump 2 back to the supply tank 1. The pump may operate at all times. Excess output returns to the supply tank 1 via the bypass arrangement. If and when the valve 60 is opened by the microprocessor, liquid flows through the dispensing system 3 to the filling hose 4 and the tank 5.

The microprocessor receives signals from sensors 21 and 61 throughout the filling process. As described below in detail, when the liquid level 9 has reached the maximum allowable value 8, the sensor signals change in such a way as to lead the microprocessor to conclude that the tank is correctly filled and the filling process should be stopped. The microprocessor then Sends a signal via signal wiring 32 to the valve 60, which closes the valve and stops the flow of liquid.

The microprocessor similarly stops the flow of liquid if an abnormal condition is detected.

The fundamental principle of all embodiments of the apparatus and method of the present invention is as follows:

1. The microprocessor monitors temperature, pressure, and flow rate signals throughout the filling process. When the liquid level 9 reaches the maximum allowable position 8, the pressure in the gas or vapor space above the liquid in the tank 5 increases to a greater or lesser degree. The reasons for this increase are described below.

2. The flow of liquid through the hose 4 thus has to deal with an increased pressure at the outlet end of the hose. Flow conditions in the dispensing system therefore have to change. To maintain the same flow rate, pressure in the dispensing system has to increase. Or, if pressure remains the same, flow rate must drop to some extent. Typically, both parameters change. When the microprocessor notes a certain signature of change of these parameters, but notes that flow is still continuing, the microprocessor concludes that the tank has been correctly filled, and stops the filling process by closing valve 60. To facilitate correct operation, the pressure sensor 21 should be downstream of any valves or other restrictive fittings, so that the pressure sensor can be exposed as directly as possible to the back pressure placed on the interior of the filling hose 4 due to conditions within the tank 5. However for ease of installation the sensor 21 should preferably be installed within the dispenser system 3.

3. If for any reason the situation described in item 2 immediately above does not result in the microprocessor stopping the fill, the fill continues until the tank is completely full. At this point there is an increase in pressure, as sensed by sensor 21, but flow stops. The signature of changes in sensor signals is completely different from the signature occurring in item 2. The microprocessor then concludes that the tank is overfilled and a warning is provided, as described in earlier sections of the description of the present invention.

FIRST EMBODIMENT

As is well known to those skilled in the art, there are two arrangements that can be used in filling a tank, when handling the types of liquids of concern in the present invention. In the "splash fill" method, liquid is released into the tank above the maximum allowable level 8. In this way there is maximum opportunity for mass transfer between gas or vapor already in the tank, and liquid coming into the tank. The result is a tendency to eliminate any pressure increase in the space above the liquid level, as the filling process goes forward. There is a potential for such pressure increase due to possible compression of the gas or vapor in the space above the liquid level, as the liquid level rises during the filling process.

Alternatively, in the "submerged fill" method, liquid is introduced near the bottom of the tank, so that most liquid is released into the tank below the liquid surface 9. As a result of the decreased intimacy of contact between gas or vapor above level 9, and liquid being supplied to the tank, the pressure in the space above the liquid level 9 may increase during the fill, for the reason described above.

Under favourable conditions, these phenomena provide a basis for determining, via the apparatus and the method of the first embodiment of the present invention, when the tank 5 has been correctly filled and therefore when the filling procedure should be stopped.

Referring to FIG. 1, there is a tube 63 permanently fixed within the tank 5. The downstream end of this tube is located exactly at the maximum allowable liquid level 8 in the tank. To begin the filling procedure, the filling hose 4 is attached to the upstream end of tube 63, by one of a variety of methods well known to those skilled in the art, and already referred to in general, above. The downstream end of the tube can be fitted with an appropriate appurtenance, well known to those skilled in the art, and therefore not shown, which creates the splash fill effect as long as the liquid level 9 is below the maximum allowable value 8. The splash fill appurtenance causes the incoming jet of liquid to be broken into smaller streams and droplets, thus enhancing mass transfer between incoming liquid, and gas or vapor in the space above the liquid level 9.

However, when the liquid level 9 reaches the downstream end of the tube 63, the splash fill phenomenon can no longer occur. The downstream end of the tube 63, and attached appurtenance if any, are now submerged and the filling procedure is automatically converted to "submerged fill". As already indicated, the result is a tendency to an increase in pressure in the gas or vapor space within tank 5, due to the fact that the rising liquid level is compressing the gas or vapor, and there is a physical limit to the rate at which the compressed gas or vapor can transfer or condense into the liquid. The further result is an increase in back pressure on the filling hose 4. The resulting increased pressure and reduced flow rate are sensed by sensors 21 and 61. Information on changes in these parameters goes to the microprocessor 30, and the microprocessor stops the filling process as already described.

SECOND AND THIRD EMBODIMENTS

The second and third embodiments can be understood through reference to FIGS. 2 and 3. All of the equipment items and features are the same as in the first embodiment, except for the devices installed inside the tank 5 which is to be filled.

To clarify the principles involved, it can be noted that in the first embodiment increased backpressure on filling hose 4 is created by increasing the pressure in the gas or vapor space in the tank, above the liquid.

By contrast, in the second and third embodiments, increased backpressure on filling hose 4 is created by increasing the restrictiveness of the flow path between the dispenser and the upper part of the internal volume of the tank being filled.

This increased restrictiveness is created at the moment that the liquid level reaches the maximum allowable position 8. The increased backpressure on the filling hose 4 creates changes in flow rate and pressure, as noted by sensors 61 and 21. The microprocessor receives information on these changes, and from this information concludes that the tank has been correctly filled. The microprocessor then closes valve 60 to stop the flow of liquid.

In the second embodiment, FIG. 2, the extra restriction is created by a "partial close" valve 64. This valve is similar to the in-tank mechanical valve described above under the heading "Background". However the partial close valve is not intended to close completely when the liquid level reaches the maximum allowable position 8.

The extent of additional restriction created by the operation of the partial close valve is not critical to the apparatus and method of the present invention. A typical partial close valve can be described as follows. When the liquid level is at position 9, well below the maximum allowable position 8, the partial close valve is wide open. For a pressure drop of 2 psi the flow rate through the valve would be on the order of 5 U.S. gallons per minute.

When the liquid level rises to position 8, the partial close valve operates and its flow characteristic is such that with a pressure drop of 2 psi across the valve the flow rate would be in the area of 2 to 3 U.S. gallons per minute.

The disadvantage of the in-tank mechanical valve which is currently in field use, namely that it may fail to close when it should, is eliminated because in the second embodiment the in-tank mechanical valve 64 does not have to close completely. If it closes partially, there is still an increase in backpressure on the filling hose 4, sufficient to lead to an increase in pressure sensed by sensor 21, and a decrease in flow rate sensed by sensor 61, so that a clear signal is sent to the microprocessor that the fill should be stopped.

In the third embodiment, FIG. 3, the exact same effect is obtained without moving parts. The tank is equipped with a permanent membrane 65 made of metal or other appropriate material of construction, depending on the liquid being handled. The membrane is placed so that the plane of the membrane coincides with the plane of the liquid surface at the moment when the liquid level in the tank reaches the maximum allowable position 8.

The membrane has a number of openings in it. The total number and the total area of the openings are established so as to create an increase in back pressure adequate to create an effect which can be noted by the sensors 21 and 61.

It should be noted in FIG. 3 that during the filling process, liquid enters through the vertical tube 63 and goes into the tank beneath the membrane. As the liquid level moves up toward the maximum allowable position 8, gas or vapor can freely move through the openings into the gas or vapor space 66 above the membrane. However it is a fact of nature that it is more difficult for a given volume of liquid to move through a given opening, in comparison with the same volume of gas or vapor.

Therefore when liquid contacts the membrane, extra pressure is required to force liquid through the openings in the membrane 65 and up into the upper portion 66 of the tank. Therefore an increased backpressure is created on tube 63 and in turn on the filling hose 4.

In both the second and third embodiments, it is desired that extra backpressure be placed on the filling hose at the time the liquid reaches the maximum allowable level 8. However it is not desired that a complete restriction be put into effect at this time. It is not desired that flow rate should go to zero. It is desired to have a change in pressure and flow rate, without flow rate going to zero, so that the microprocessor can recognize this change as the characteristic "signature" of the tank being correctly filled.

If due to some malfunction the fill continues past the correct point, then the tank will become completely filled. There will be a different "signature" of pressure and flow rate change, and the flow rate will go to zero. The microprocessor then knows that the tank is overfilled and a warning is provided immediately.

ABNORMAL OPERATION—TANK ALREADY FILLED

Assume that a tank is presented to be filled but the tank is already filled to the maximum allowable liquid level. The apparatus and the method of the present invention provide for detection of this situation.

After the filling process starts, the first change in the readings produced by the sensors 21 and 61 will be accompanied by the flow rate going to a low value (first embodiment) and ultimately to zero (all embodiments). In this way the microprocessor will be able to conclude that the tank is overfilled and a warning of that fact is provided.

TEST RESULTS

The second and third embodiments were tested in the course of filling tanks with water. Water simulates a carbonated beverage. Water can also simulate saturated liquids such as liquid propane or liquid chlorine, because in the apparatus and method of the present invention any liquids handled are under pressure, and in the case of saturated liquids in particular there would be no tendency to flash to vapor.

In actual commercial or field use, the pressure in the tank which is being filled is not known, during the fill. Information on this pressure is not required for the operation of the present invention. However in testing, in order to gain a more complete understanding of the operation, the pressure in the tank was measured during test fills.

The apparatus used in the tests was such that the pressure drop between the outlet of the pump, as sensed by sensor 21, and the upper part of the interior of the tank, was essentially zero. In other words, during the filling process, the flow path was not restrictive.

Tests were made with a partial close valve (second embodiment). When the partial close valve operated, as the liquid level approached the maximum allowable position, the pressure drop increased to approximately 10 psi.

This was a strong signal readily sensed by the microprocessor. A smaller pressure increase on the order of, for example, 5 psi, would be more than adequate.

Tests of the third embodiment were carried out. Again when the liquid level was well below the maximum allowable value, the pressure difference between the location of the pressure sensor, and the region 66 of the tank being filled (FIG. 3), was essentially zero. When the liquid level reached the membrane, the pressure difference immediately increased to the area of 8 psi.

I claim:

1. An apparatus for filling a tank with a liquid, said apparatus comprising:

i) a tank with an inlet;

ii) a liquid supply capable of providing liquid at a pressure adequate to ensure flow of said liquid into said tank;

iii) a fluid conduit connectable between said supply and said tank to allow fluid communication therebetween;

iv) a tube permanently installed within said tank, said tube originating at said inlet and ending at a point in an imaginary plane coincident with the liquid surface which would exist in said tank if said tank were filled with said liquid to the maximum allowable extent;

v) a mechanical device within said tank to partially obstruct the liquid flow in said conduit when said liquid reaches said imaginary plane so that further flow of said liquid through said tube is at a lower rate for the same pressure driving force, or requires a higher pressure driving force for the same flow rate;

vi) at least one sensor located in said fluid conduit upstream of said inlet to generate a control signal when the pressure and liquid flow rate in said conduit correspond to the pressure and liquid flow rate created by said mechanical device when the liquid level in said tank reaches said imaginary plane; and vii) a fluid dispensing control means connected to said sensor, for stopping liquid flow through said conduit in response to said control signal.

2. An apparatus as in claim 1 wherein said mechanical device is a partial close valve.

3. An apparatus as in claim 1 wherein said mechanical device is a membrane positioned in said imaginary plane.

* * * * *